US005176547A

United States Patent [19]

Kobayashi et al.

[11] Patent Number: 5,176,547

[45] Date of Patent: Jan. 5, 1993

[54] WATER JET PROPULSION UNIT

[75] Inventors: Noboru Kobayashi; Yoshiki Futaki, both of Iwata, Japan

[73] Assignee: Yamaha Hatsudoki Kabushiki Kaisha, Iwata, Japan

[21] Appl. No.: 756,888

[22] Filed: Sep. 9, 1991

[30] Foreign Application Priority Data

Sep. 11, 1990 [JP] Japan ..... 2-242075

[51] Int. Cl.[5] ..... B63H 11/08

[52] U.S. Cl. ..... 440/38; 440/46

[58] Field of Search ..... 440/38, 39, 40, 41, 440/42, 43, 61, 63, 46; 114/270; 60/221

[56] References Cited

U.S. PATENT DOCUMENTS 3,116,710 1/1964 Cass ..... 440/61
4,325,699 4/1982 Castoldi ..... 440/47

FOREIGN PATENT DOCUMENTS 386760 9/1990 European Pat. Off. ..... 440/40
2732671 2/1979 Fed. Rep. of Germany ..... 440/38

*Primary Examiner*—Jesus D. Sotelo
*Assistant Examiner*—Stephen P. Avila
*Attorney, Agent, or Firm*—Ernest A. Beutler

[57] ABSTRACT

A water jet propelled watercraft having a hull defining a downwardly facing water inlet opening and a jet propulsion unit contained within the hull and having a water inlet opening portion through which water is drawn, an impeller portion containing an impeller for drawing the water and a discharge nozzle portion through which the water pumped by the impeller is discharged for powering the watercraft. The jet propulsion unit is supported for pivotal movement within the hull about a transversely extending horizontal axis. The water inlet opening of the jet propulsion unit water inlet portion and a corresponding portion of the hull water inlet opening are defined by mating flanges that lie in a plane that contains the horizontal pivotal axis to minimize sealing pressure variations on the seal therebetween. A screen is positioned over the water inlet opening of the jet propulsion unit and tapers and curves downwardly to end at the undersurface of the lower side of the hull so that foreign material separated from the incoming water by the screen can easily flow backwardly along the bottom of the hull for removal during movement of the watercraft. The jet propulsion unit is also rotatable about a longitudinally extending axis and the defining flange of the water inlet portion is narrower at the front than the rear to permit rotational movement with a minimum of clearances.

28 Claims, 5 Drawing Sheets

WATER JET PROPULSION UNIT

BACKGROUND OF THE INVENTION

This invention relates to a water jet propulsion unit and more particularly to an improved watercraft powered by a jet propulsion unit.

Jet propulsion units are achieving great popularity as the propulsion unit for watercraft. The jet propulsion unit has many advantages in that it permits the operation in a shallow body of water and also, when concealed within the hull, provides a very neat watercraft appearance. However and particularly when mounted within the hull of the watercraft, there are some disadvantages with jet propulsion units. That is, if the jet propulsion unit is mounted in a fixed position within the hull, then its water inlet will always be submerged even when the watercraft is not in use. Incrustation can build up on the water jet propulsion unit under these circumstances.

To avoid these problems, it has been proposed to provide a water jet propulsion unit of the type wherein the jet propulsion unit is mounted for movement within the hull between a lowered in the water operative position and a raised storage position wherein the water inlet portion of the jet propulsion unit is raised above the body of water in which the watercraft is operating. One convenient way in which this may be done is to mount the jet propulsion unit for pivotal movement about a transversely extending horizontal axis within a tunnel of the watercraft. Such an arrangement is shown in the co-pending application of the same title, Ser. No. 735,154, filed Jul. 22, 1991 in the name of Noboru Kobayashi, which application is a continuation of his earlier application, Ser. No. 489,361, filed Mar. 6, 1990 and now abandoned, which applications are assigned to the assignee hereof.

In accordance with the arrangement shown in that application, it is the normal practice to provide a water inlet opening in the lower portion of the hull of the watercraft which cooperates with the water inlet opening of the jet propulsion unit to direct water from the body of water in which the watercraft is operating into the jet propulsion unit. It is desirable provide mating sealing surfaces between the jet propulsion unit water inlet portion and the hull around its water inlet opening to improve the efficiency of the jet propulsion unit. With the prior art type of constructions, these sealing surfaces have generally been horizontally disposed in a plane generally parallel to but spaced from the pivot axis of the jet propulsion unit. This means that the seal between these surfaces is disposed in such a way that uneven sealing pressures are exerted when the jet propulsion unit is moved to its normal operative position. There are, obvious disadvantages with such an arrangement.

It is, therefore, a principal object to this invention to provide an improved sealing structure between the hull of a watercraft and the water inlet portion of a jet propulsion unit that is pivotally supported within the hull so as to improve the sealing arrangement and maintain uniform sealing pressure around the periphery of the water inlet.

It is a further object to this invention to provide an improved sealing arrangement for the moveable jet propulsion unit of a watercraft.

One way in which the sealing pressure can be made more uniform is to provide the mating sealing surfaces to lie in a plane that is angularly disposed and upwardly inclined so as to intersect and contain the axis of pivotal movement of the jet propulsion unit. It is, however, also desireable to provide a screen across the water inlet opening of the jet propulsion unit to prevent the ingestion of foreign materials such as seaweed or the like. However, when the water inlet opening is angularly disposed and a screen is incorporated, then the angularly disposition of the opening can cause pockets wherein foreign material can accumulate and build up.

It is, therefore, a still further object to this invention to provide an improved water inlet configuration for a jet propulsion unit wherein an angularly disposed screen is incorporated but wherein the build of foreign material on the screen will be precluded.

In addition or in leu of the pivotal movement about the transverse horizontally extending axis, it has also been proposed to support the jet propulsion unit for rotation about a generally longitudinally extending axis so that the water inlet opening may be rotated from a downwardly facing position to an upwardly facing position. In addition to raising the water inlet opening out of the body of water in which the watercraft is operating, this type of support also facilitates access of the water inlet opening through an access opening of the hull for servicing and removing foreign material from the water inlet opening. However, where such rotational support is incorporated, it must be insured that the rotational movement is such that there will not be interference between the water inlet portion of the jet propulsion unit and the hull. This can become a particular problem when the water inlet opening is disposed at an angle to the horizontal so as to improve the sealing, as aforenoted.

It is, therefore, a further object to this invention to provide a water inlet configuration for a jet propulsion unit that will facilitate rotational movement of the jet propulsion unit with minimum interference.

SUMMARY OF THE INVENTION

A first feature of this invention is adapted to be embodied in a jet propelled watercraft having a hull with a lower surface that forms a water inlet opening. A jet propulsion unit is supported within the hull and has a water inlet portion through which water is drawn from the body of water in which the watercraft is operated, an impeller portion containing an impeller for drawing water through the water inlet portion and a nozzle discharge portion through which the water moved by the impeller is discharged for propelling the watercraft. The jet propulsion unit is supported for pivotal movement within the hull about a generally transversely extending horizontal axis between a lowered position and a raised position. The jet propulsion unit and the hull have facing sealing surfaces that are adapted to be sealing engaged when the jet propulsion unit is in its lowered position. These surfaces are generally upwardly inclined toward the front end thereof.

Another feature of the invention is adapted to be embodied in the water inlet configuration for a jet propelled watercraft. In such an arrangement, the watercraft has a jet propulsion unit and water inlet therefore that define a downwardly facing water inlet opening for delivering water to an impeller portion of the jet propulsion unit. A screen is disposed in angular relationship across the water inlet opening for precluding the ingestion of foreign material. The screen is configured so that it tapers downwardly and rearwardly and so that its lower rear edge is coincident with the lower surface of the hull for precluding the build up of foreign material across the mouth of the screen.

Yet another feature of the invention is adapted to be embodied in a water inlet portion of a jet propelled watercraft that has a downwardly facing water inlet opening. A jet propulsion unit is mounted with its water inlet opening in proximity to the hull water inlet opening and for rotation about a generally longitudinally extending axis. In accordance with this feature of the invention, the water inlet opening of the jet propulsion unit is defined by a flange that is narrower at its front end then at its rear end so as to minimize interference upon rotation of the jet propulsion unit relative to the hull.

DETAILED DESCRIPTION OF THE PREFERRED EMBODIMENT OF THE INVENTION

Figure 1:
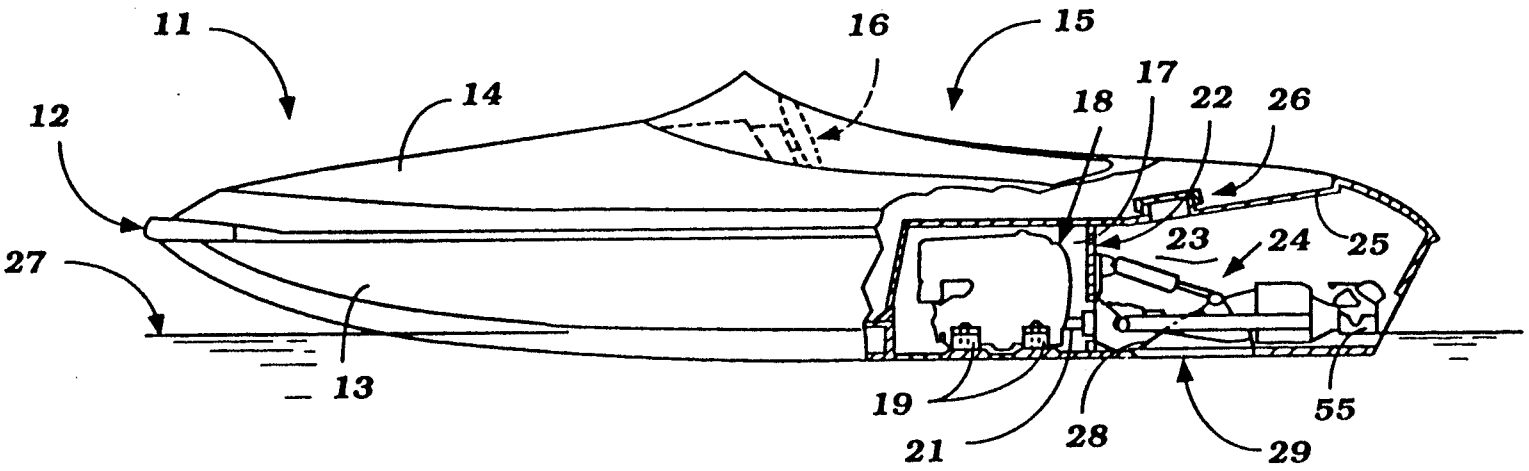
FIG. 1 is a side elevational view of a watercraft powered by a jet propulsion unit constructed in accordance with an embodiment of the invention, with a portion broken away so as to more clearly show certain details of the construction.

Referring first in detail to FIG. 1, a watercraft having a jet propulsion unit constructed and mounted in accordance with an embodiment of the invention is identified generally by the reference numeral 11. The watercraft 11 has a hull, indicated generally by the reference numeral 12 which may have any suitable configuration and which may be comprised of a lower hull portion 13 and a deck portion 14 with these portions being formed from suitable material such as a molded fiberglass reinforced resin. In the illustrated embodiment, the hull 12 is provided with a rearwardly positioned passenger compartment 15 in which a steering wheel 16 and other controls are provided for operating the watercraft 11.

The central rear portion of the lower part of the hull 13 is formed with an engine compartment 17 in which an internal combustion engine 18 of any known type is mounted on engine supports 19. The engine 18 has its output shaft 21 extending rearwardly through a bulkhead 22 formed forwardly of a tunnel 23 that extends generally along the longitudinal axis of the watercraft and in which a jet propulsion unit, indicated generally be reference numeral 24 is positioned. The tunnel 23 is defined in part by a horizontally extending surface 25 of the hull 12 in which an access opening 26 is provided for a purpose to be described. The watercraft 11 is designed to be operated in a body of water at a normal water level as shown by the line 27 in FIG. 1.

Figure 2:
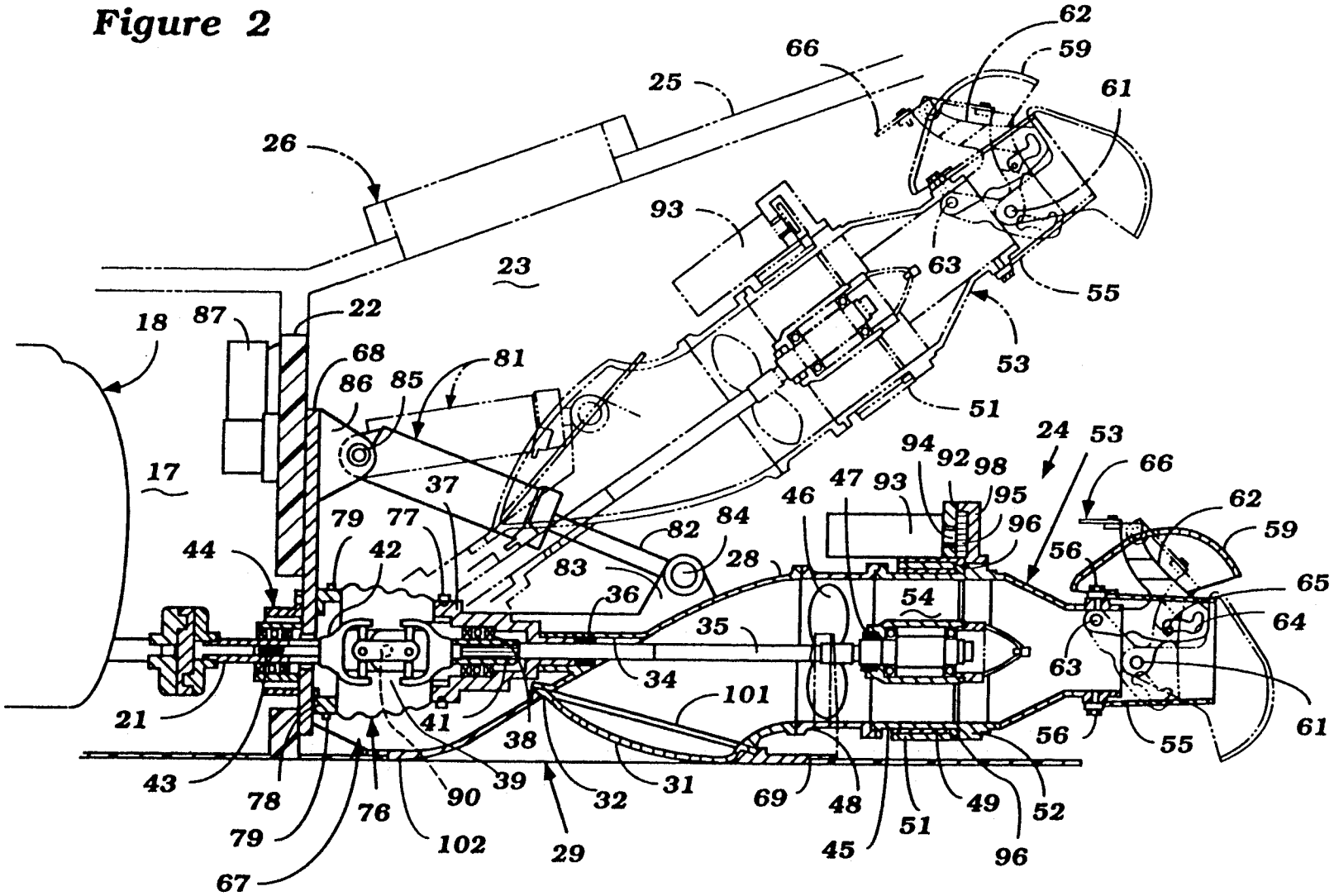
FIG. 2 is an enlarged cross sectional view of the broken away area of FIG. 1 showing the propulsion unit in its normal position in solid lines and in its out of the water servicing position in phantom lines.
Figure 3:
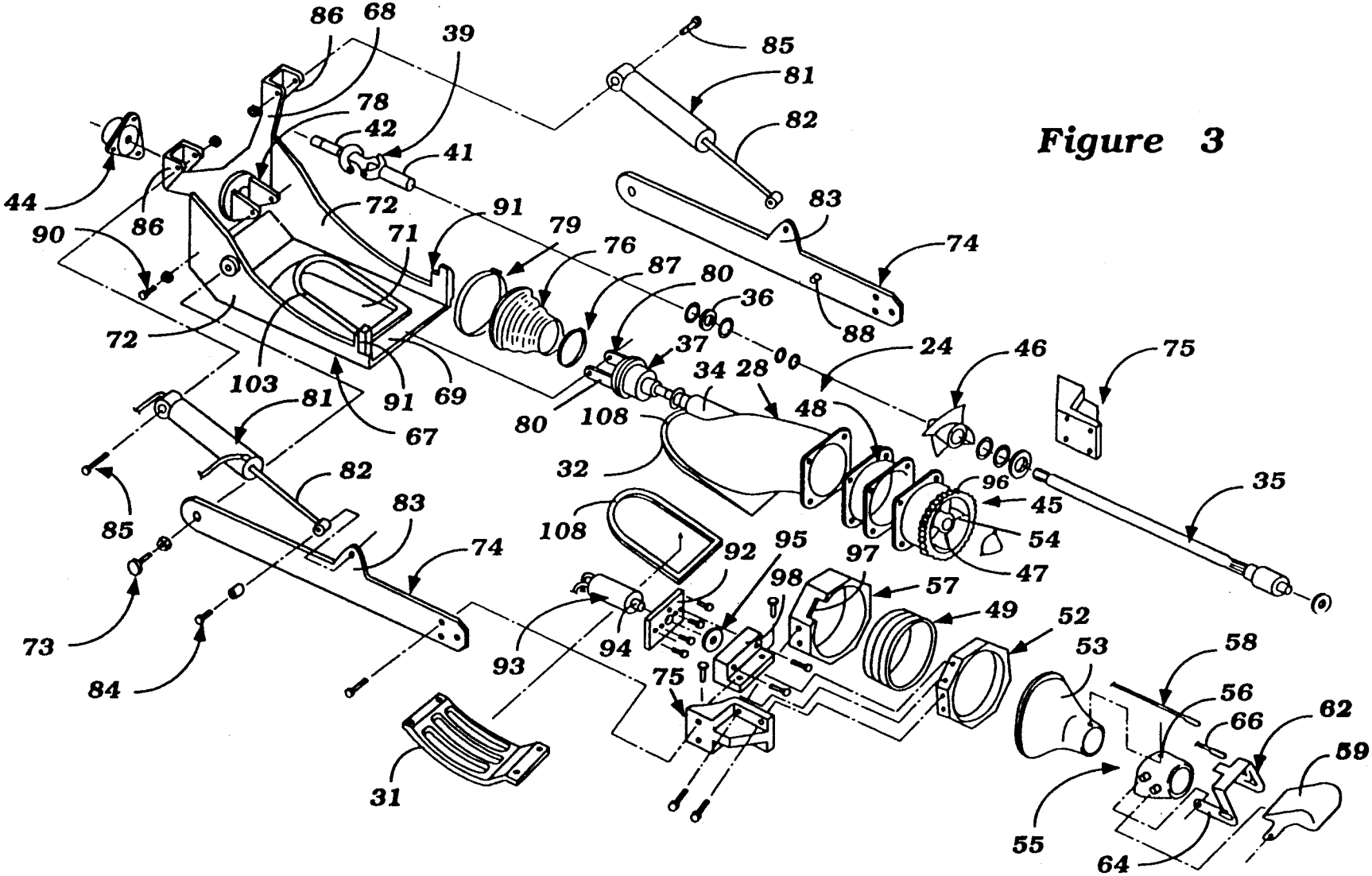
FIG. 3 is an exploded perspective view showing the jet propulsion unit and its mounting arrangement within the watercraft.

Referring now to the remaining figures and initially primarily to FIGS. 2 and 3, the jet propulsion unit 24 includes an outer housing that is comprised of an inlet portion 28 that defines a downwardly facing water inlet opening 29. The inlet opening 29 is defined by a grill like screen 31 that is affixed to a housing flange 32 of the housing portion 28 and which also faces downwardly. The flange 32 has generally rectangular configuration which is curved at its forward edge for a reason to be described.

The water inlet portion 28 has a forwardly extending pilot portion 34 that passes an impeller shaft 35. A seal 36 surrounds the impeller shaft 35 within the portion 34 and provides a water seal to preclude water leakage.

The forward end of the housing portion 34 receives a fitting 37 that carries a seal and bearing 38 for journalling the impeller shaft 35 adjacent the forward end thereof. A universal joint, indicated generally by the reference numeral 39 has a yoke portion 41 that has a splined connection to the impeller shaft 35. The yoke portion 41 is, in turn, connected to a further yoke portion 42 that has a splined connection 43 to the engine output shaft 21. This splined connection is contained within a bushing 44 which is mounted in a manner to be described. The aforedescribed connection permits a driving connection between the engine output shaft 21 and the impeller shaft 35 which also permits the jet propulsion unit 24 to be pivoted about a transverse, horizontal axis as defined by the universal joint 39 and a further construction, to be described.

Rearwardly of the inlet portion 28 of the jet propulsion unit outer housing, there is provided an impeller housing, indicated generally by the reference numeral 45 in which an impeller 46 is contained. The impeller 46 is suitably coupled to the impeller shaft 35. The rear end of the impeller shaft 35 is journaled within a bearing assembly 47 that is carried in the impeller housing 45 of the jet propulsion unit housing in a suitable manner. A flange assembly, indicated generally by the reference numeral 48 is provided at the forward portion of the impeller housing 45 for attaching the impeller housing 45 to a corresponding flange of the water inlet portion 28.

The impeller housing 45 is formed with a cylindrical surface that is journaled by means of a bushing 49 within a bearing member 51. The bearing member 51 is, in turn, affixed by means of a coupling plate 52 to a discharge nozzle 53 which also forms a component of the outer housing assembly of the jet propulsion unit 24. The discharge nozzle 53 receives water which has been discharged from the impeller section 45 by the impeller 46 past straightening vanes 54 formed integrally with the impeller housing 45.

A steering nozzle, indicated generally by the reference numeral 55 is supported for steering movement at the discharge end of the discharge nozzle 53 by means of vertically extending pivot pins 56. The steering nozzle 55 has an outwardly extending steering arm (not shown) formed integrally with it to which a bowden wire 58 is affixed by a suitable coupling. The forward end of the bowden wire 58 is connected to the steering wheel 16 in appropriate manner for steering of the watercraft in a manner as is well known with such jet propulsion units.

A reverse thrust bucket 59 has arm portions that are journaled on opposite sides of the steering nozzle 55 by means of pivot pins 61 for movement between a normal forward drive position as shown in solid lines in FIG. 2 and in a reverse thrust position as shown by ..- lines in this same figure. An actuating lever 62 is also pivoted on the steering nozzle 55 by means of pivot pins 63 and has a cam slot 64 that receives pins 65 of the reverse thrust bucket 59. An operating bowden wire 66 is connected to the actuating lever 62 and is operative when pulled to pivot the actuating lever 62 and move the reverse thrust bucket 59 between its forward and reverse positions. The forward end of the bowden wire 66 is connected to an appropriate control positioned in the passenger compartment 15 which control does not appear in the figures.

The construction by which the jet propulsion unit 24 is mounted within the tunnel 23 will now be described still by particular reference to FIGS. 2 and 3. This mounting arrangement includes a cradle assembly, indicated generally by the reference numeral 67 which is affixed in a suitable manner to the rear side of the bulkhead 22 and to which bushing 44 is affixed. The cradle assembly 67, has a generally vertically extending wall 68 that is positioned in confronting relationship to the rear side of the bulkhead 22 and a horizontally extending portion 69 in which an opening 71 is formed which opening registered with the inlet opening 29 of the jet propulsion unit housing portion 28 in a manner to be described.

The cradle assembly 67 also has a pair of vertically extending side walls 72 that are integrally connected with the front wall 68 and the bottom wall 69 so as to offer reinforcing. In addition, the side walls 72 receive pivot bolts 73 that are aligned with the universal joint 39, for a reason to be described, and which pivotally journal a pair of spaced apart support arms 74 at their forward ends. The support arms 74 are, in turn, affixed at their rear ends to mounting brackets 75 which brackets are affixed by threaded fasteners to the support arm 74 and to the bearing member 51. As a result of this construction, the jet propulsion unit 24 will be pivotally supported by the cradle assembly 67 about a transversely extending horizontal pivot axis defined by the pivot bolts 73.

This pivotal movement is accommodated by the universal joint 39 as aforedescribed. The universal joint 39 is encircled and sealed by means of a flexible boot 76 that is secured to the fitting 37 by means of a clamp 77 and secured to an extending portion 78 of the mounting cradle assembly 67 by means of a clamp 79 so as to provide good water tight sealing for the universal joint 39 while permitting its free rotation and free pivotal movement.

The fitting 37 has a pair of forwardly extending arms 80 that are pivotally connected to a pair of extending arms of the portion 78 of the cradle 72 by means of pivot bolts 90 so as to further provide pivotally support for the jet propulsion unit 24 relative to the cradle assembly 67.

The pivotal movement of the jet propulsion unit 24 about the horizontally disposed transverse axis defined by the pivot bolts 73 and 90 permits movement of the jet propulsion unit 24 from its normal operative position as shown in FIG. 2 to an elevated position as shown in the phantom line view of FIG. 2. This permits the water inlet 29 to be raised out of the body of water in which the watercraft is operating above the normal water level 27 so as to preclude the likelihood of incrustation occurring on the water inlet portion 29.

A power operated device is incorporated so as to pivot the jet propulsion unit 24 about the aforedescribed horizontally extending transverse axis. This power device includes a pair of hydraulicly operated cylinders 81 that have piston rods 82 connected to an extending portion 83 of the supporting arms 74 by means of pivot bolts 84. The cylinders of the units 81 are pivotally connected, by means of pivot bolts 85 to mounting portions 86 formed integrally with the cradle assembly 67 at the upper end of its vertically extending portion 68 on opposite sides thereof. In order to supply fluid under pressure to actuate the fluid cylinders 81, there is provided an electrically driven reversible pump and valve assembly, indicated generally by the reference numeral 87, that is mounted on the forward side of the bulkhead 22 and which is controlled by a suitable remotely positioned controller (not shown).

It should be readily apparent that there are substantial side thrusts generated on the jet propulsion unit 24 when in its operating position and particularly when the steering nozzle 55 is pivoted. The support arms 74 and their rigid connection to the bearing member 51 through the mounting bracket 75 insures a rigid assembly that will take these side thrusts. In addition, the support arms 74 have inwardly extending pin portions 88 which are received in complementary recesses formed in upstanding portions 91 of the cradle assembly 67 when the jet propulsion unit 24 is in its normal operative position so as to insure a rigid assembly with minimum likelihood of movement under these forces. In addition and unlike prior art constructions, no pin and slot arrangement is required for controlling the pivotally movement of the jet propulsion unit 24 and, accordingly, an extremely rigid, noise free and strong construction will result.

It should be readily apparent that the pivotal movement of the jet propulsion unit 24 between its normal operative position and its raised out of the water position can be accommodated by flexure of the wire actuators 58 and 66. Their protective sheaths are affixed by means of a fastener or retainer to the mounting bracket 75 at one side of the jet propulsion unit 24 so as to insure against kinking of the transmitters.

In addition to the pivotal movement about the transversely extending horizontal axis, the jet propulsion unit 24 is constructed so that the water inlet portion 28 may be rotated between a downwardly facing position as shown in FIGS. 1, the solid line view of FIG. 2, and an upwardly facing position as shown in the phantom line view of FIG. 2. This brings the water inlet opening 29 in registry with the access opening 26 so that any entrapped foreign material may easily be removed without necessitating removal of the watercraft 11 from the body of water in which the watercraft is operating. It is not necessary to rotate the entire jet propulsion unit 24 but only the water inlet portion 28 thereof. The structure for accomplishing this result is also shown in FIGS. 2 and 3.

It has been previously noted that the impeller housing 45 is mounted within the bearing member 51 for rotation by the bushing 49 and that the impeller housing 45 is affixed to the water inlet portion 28. The bearing member 51 also has mounted to it, by means of a supporting bracket 92, an electric drive motor 93. The electric drive motor 93 has a driven shaft 94 to which is affixed a drive gear 95. The drive gear 95 is enmeshed with a driven ring gear 96 which is formed integrally with the impeller housing 45. This drive gear 95 extends through a notch 97 formed in the bearing member 51 and is enclosed by means of a cover plate 98 so as to provide a driving arrangement between the drive gear 95 and the driven ring gear 96. When the motor 93 is energized, the ring gear 96 will be rotated along with the impeller housing 45 and water inlet portion 28 from a downwardly facing position, as aforenoted, to the upwardly facing service position. When in this position as shown in phantom in FIG. 2, servicing can be possible by permitting clearing of foreign material from the water inlet 29 and specifically from the screen 31. However, since the discharge nozzle 53 and steering nozzle 55 do not rotate, there is no problem with damaging the wire transmitters 58 or 66 or for accommodating such rotary motion at was necessary with the prior art constructions.

The construction of the jet propulsion unit 24 as thus far described may be considered to be substantially the same as that shown in the co-pending application of Noboru Kobayashi and Yoshiki Futaki, entitled "Water Jet Propulsion Unit," Ser. No. 680,709, filed Apr. 4, 1991 and assigned to the assignee hereof. For that reason, reference to that disclosure is incorporated herein by reference and reference may be had to that application for the details of any portions of the construction not herein described.

It has been the normal practice to provide some form of seal between the jet propulsion unit water inlet opening flange 32 and a corresponding flange which forms the water inlet opening 71 of the hull, in this case the cradle 67. Conventionally, these seals have extended in a horizontal direction along with the respective openings of the hull and jet propulsion unit 24. However, such horizontally extending sealing surfaces are disposed at a plane that is below the transverse pivotal axis 73, 90 of the jet propulsion unit 24. As a result, when these sealing surfaces move into engagement, there is an unequal sealing pressure and detrimental results can occur.

In accordance with the invention, therefore, the flange 32 of the jet propulsion inlet portion 28 lies in a plane 101 (FIGS. 2 and 4) when the jet propulsion unit 24 is in its normal lowered operative position. This plane 101 intersects the pivot axis 73, 90 of the jet propulsion unit for a reason which will become apparent. The hull water inlet opening 71 which is formed in the lower member 69 of the cradle 67 is defined by an upwardly curved section 102 that terminates in a flange 103 that extends in a plane parallel to the plane 101 or substantially coincident with it. An annuler seal 104 is affixed to one of the flanges 32 or 103, in a suitable manner. In this embodiment the seal 104 is affixed to the jet propulsion unit water inlet portion 28. As a result of this configuration, the seal 104 lies in the plane 101 which is inclined upwardly in a forward direction and which plane is coincident with the pivot axis defined by the pivot pins 72 and 90. Accordingly, equal sealing pressure will exist along the entire seal and no problems will be encountered.

Figure 4:
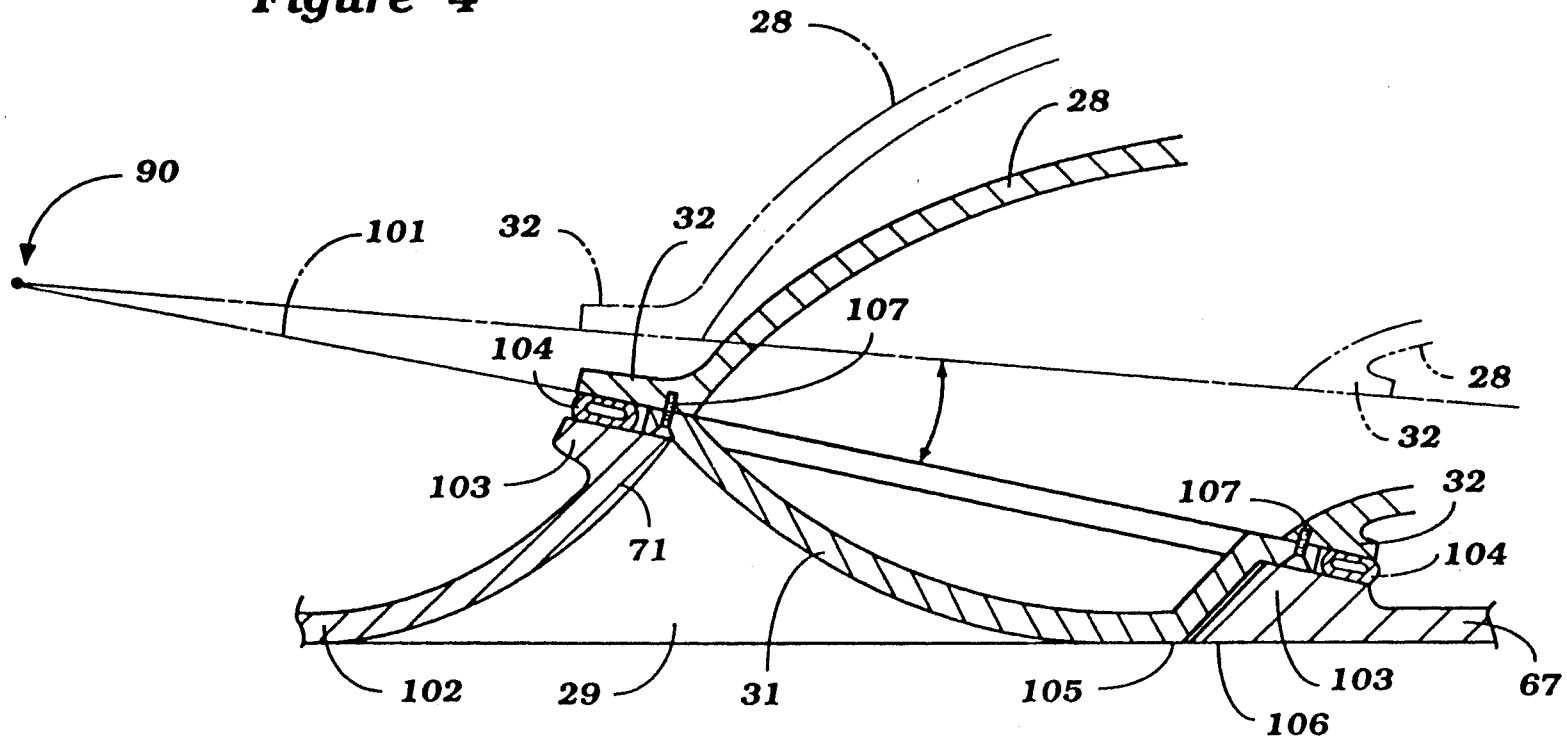
FIG. 4 is a further enlarged cross sectional view taken along a plane parallel to the plane of FIG. 2 and shows the relationship between the water inlet opening of the hull and the water inlet portion of the jet propulsion unit.

It should also be noted from FIG. 4 that because of the inclination of the seal 104 the screen 31 will also extends upwardly at an angle. In accordance with an important feature of the invention, the screen 31 is curved so that its lower rear surface 105 is aligned and co-planer with a forward edge 106 of the opening 71 formed by the cradle lower portion 69. As a result, any seaweed or other material which may accumulate at the base of the screen 31 will be swept rearwardly and washed free of the screen 31 during the motion of the watercraft 11. That is, there is no pocket formed in this area wherein the foreign material may accumulate and be trapped. In this figure, the screws 107 that serve to fasten the screen 31 to the jet propulsion unit water inlet portion 28 and specifically its flange 32 are clearly shown.

Figure 5:
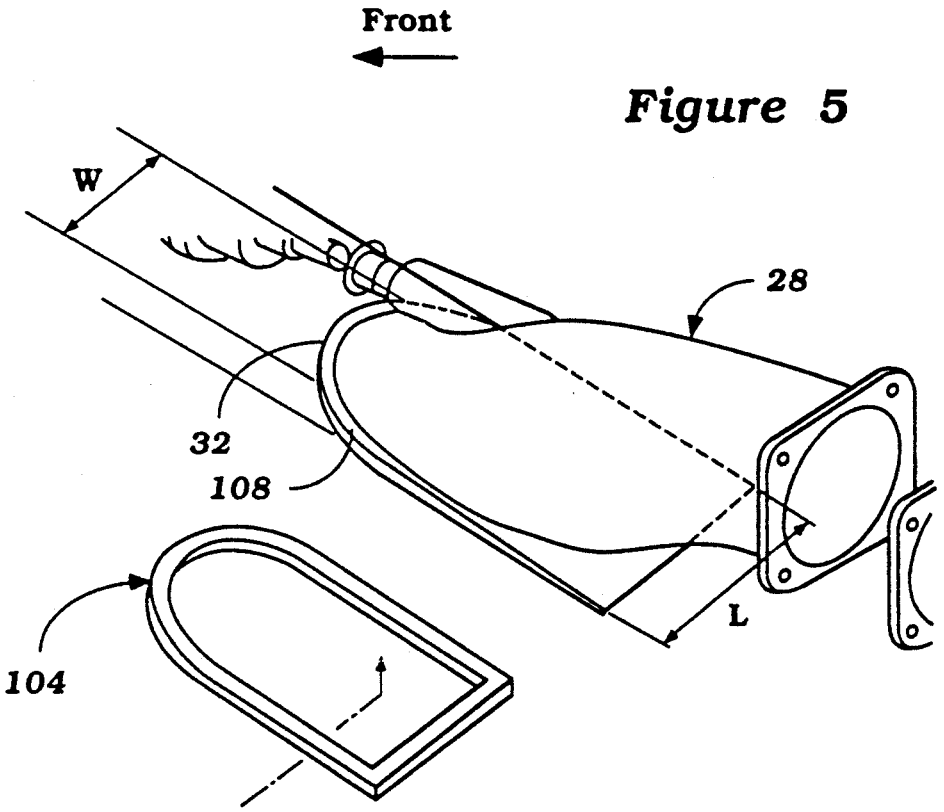
FIG. 5 is a further enlarged perspective view showing the relationship between the water inlet portion of the jet propulsion unit and the seal, in part similar to FIG. 3, and shows the configuration of the water inlet opening of the jet propulsion unit.

It has also been previously noted that the water inlet portion 28 of the jet propulsion unit 24 also rotates about a longitudinal axis, the axis defined by the impeller shaft 35. Because of the angular inclination of the flange 32, this could cause interference upon rotation. However, in accordance with a feature of the invention, the forward edge of the flange 32 is provided with an arcuately curved section 108 and the seal 104 is similarly formed. This arcuate curvature 108 provides a lesser width W at the front of the opening than the greater with L at the rear (See FIG. 5). Because of this configuration there will be better clearance and the unit can be rotated by lifted it only slightly above the water inlet opening 72.

It should be readily apparent from the foregoing description that the described construction permits very effective sealing around the water inlet portion of the jet propulsion unit and the corresponding water inlet opening formed in the hull while maintaining equal loading on the seal therebetween. In addition, the configuration is such that foreign material that may become extracted from the water before it enters the jet propulsion unit through the screen, will be swept away from the screen by the movement of the watercraft and also that rotational movement of the jet propulsion unit is facilitated with minimum clearances. Of course, the foregoing description is that of a preferred embodiment of the invention and various changes and modifications may be made without departing from the spirit and scope of the invention, as defined by the appended claims.

We claim:

1. A jet propelled watercraft having a hull defining a generally downwardly facing water inlet opening in a lower surface thereof, a jet propulsion unit having a water inlet portion having a downwardly facing opening through which water may be drawn, an impeller housing for supporting an impeller for drawing water through said water inlet portion, and a discharge nozzle portion through which water pumped by said impeller is discharged for powering said watercraft, means for supporting said jet propulsion unit for pivotal movement relative to said hull about a generally transversely extending horizontal axis between a lowered position and a raised position, said jet propulsion unit and said hull having facing surfaces adapted to be sealing engaged when said jet propulsion unit is in its lowered position, said surfaces being generally upwardly inclined toward the front thereof.

2. A jet propelled watercraft as set forth in claim 1 wherein the horizontally pivot axis is disposed forwardly of the water inlet opening.

3. A jet propelled watercraft as set forth in claim 2 wherein the surfaces lie in a plane that includes the horizontal axis.

4. A jet propelled watercraft as set forth in claim 3 wherein the surfaces are defined by respective flanges formed by the hull and the jet propulsion unit water inlet portion.

5. A jet propelled watercraft as set forth in claim 1 wherein the surfaces lie in a plane that includes the horizontal axis.

6. A jet propelled watercraft as set forth in claim 5 further including a screen extending across the inlet opening of the water inlet portion of the jet propulsion unit for removing foreign material therefrom.

7. A jet propelled watercraft as set forth in claim 6 wherein the trailing edge of the screen lies in the same horizontal plane as the trailing edge of the opening of the hull so that foreign material extracted by the screen can freely flow along the screen and the bottom of the hull during the motion of the watercraft through the body of water.

8. A jet propelled water craft as set forth in claim 1 wherein the jet propulsion unit is rotatable about a longitudinally extending axis to bring the water inlet portion of the jet propulsion unit from a downwardly facing position to a raised position.

9. A jet propelled watercraft as set forth in claim 8 wherein the water inlet opening of the jet propulsion unit inlet portion is defined by a peripheral flange, said peripheral flange being narrower at the front then the rear to permit rotational movement within a minimum of clearance.

10. A jet propelled watercraft as set forth in claim 1 wherein the jet propulsion unit is disposed in a tunnel formed in the lower portion of the hull.

11. A jet propelled watercraft as set forth in claim 10 wherein the tunnel is enclosed on at least a portion of its lower surface by means of a support plate for the jet propulsion unit in which the water inlet opening of the hull is formed.

12. A jet propelled watercraft as set forth in claim 11 wherein the horizontally pivot axis is disposed forwardly of the water inlet opening.

13. A jet propelled watercraft as set forth in claim 12 wherein the surfaces lie in a plane that includes the horizontal axis.

14. A jet propelled watercraft as set forth in claim 13 wherein the surfaces are defined by respective flanges formed by the hull and the jet propulsion unit water inlet portion.

15. A jet propelled watercraft as set forth in claim 11 wherein the surfaces lie in a plane that includes the horizontal axis.

16. A jet propelled watercraft as set forth in claim 15 further including a screen extending across the inlet opening of the water inlet portion of the jet propulsion unit for removing foreign material therefrom.

17. A jet propelled watercraft as set forth in claim 16 wherein the trailing edge of the screen lies in the same horizontal plane as the trailing edge of the opening of the hull so that foreign material extracted by the screen can freely flow along the screen and the bottom of the hull during the motion of the watercraft through the body of water.

18. A jet propelled watercraft as set forth in claim 11 wherein the water inlet opening of the jet propulsion unit inlet portion is defined by a peripheral flange, said peripheral flange being narrower at the front then the rear to permit rotational movement within a minimum of clearance.

19. A jet propelled watercraft as set forth in claim 18 wherein the water inlet opening of the jet propulsion unit inlet portion is defined by a peripheral flange, said peripheral flange being narrower at the front then the rear to permit rotational movement within a minimum of clearance.

20. A water jet propelled watercraft having a hull defining a generally downwardly facing water inlet opening in a lower surface thereof, a jet propulsion unit having a water inlet portion having a downwardly facing opening through which water is drawn from the body of water in which the watercraft is operated, an impeller housing containing an impeller for drawing water through said water inlet portion and a discharge nozzle portion for discharging water pumped by said impeller to power said watercraft, said jet propulsion unit water inlet portion and said hull said water inlet opening meeting along an inclined surface, and screen means affixed across the inlet opening of said jet propulsion unit water inlet portion for removing foreign material therefrom, said screen means terminating at its rearward end at a horizontal plane substantially coincident with the plane at the rear edge of the hull water inlet opening for permitting foreign materials separated from the water drawn into said water inlet portion to flow rearwardly along the underside of the said hull.

21. A water jet propelled watercraft as set forth in claim 20 wherein the screen has a generally curved lower surface.

22. A water jet propelled watercraft as set forth in claim 20 wherein the meeting inclined surface of the jet propulsion unit water inlet portion and the hull water inlet opening is upwardly inclined in a forward direction.

23. A water jet propelled watercraft having a hull defining a generally downwardly facing water inlet opening in a lower surface thereof, a jet propulsion unit having a water inlet portion having a downwardly facing opening through which water is drawn from the body of water in which the watercraft is operated, an impeller hosing containing an impeller for drawing water through said water inlet portion and a discharge nozzle portion for discharging water pumped by said impeller to power said watercraft, means for mounting at least said water inlet portion for movement from a downwardly facing position to a raised position, said water inlet opening of said jet propulsion unit water inlet portion being described by an outstanding flange that is narrower at one end thereof than at the other thereof for facilitating clearance of said jet propulsion unit during movement between said positions.

24. A water jet propelled watercraft as set forth in claim 23 wherein the water inlet portion of the jet propulsion unit is mounted for rotational movement about a longitudinally extending axis and the water inlet opening of the jet propulsion unit is narrower at the front than at the rear.

25. A water jet propelled watercraft as set forth in claim 24 wherein the jet propulsion unit is supported for pivotal movement relative to the hull about a transversely disposed horizontally extending axis.

26. A water jet propelled watercraft as set forth in claim 25 wherein the horizontal pivotal axis is diposed forwardly of the water inlet opening.

27. A water jet propelled watercraft as set forth in claim 26 wherein the water jet propulsion unit water inlet portion and hull water inlet opening meet along upwardly inclined surfaces.

28. A water jet propelled watercraft as set forth in claim 23 wherein the water jet propulsion unit water inlet portion and hull water inlet opening meet along upwardly inclined surfaces.

* * * * *